US010821308B1

(12) United States Patent
Krumrei

(10) Patent No.: US 10,821,308 B1
(45) Date of Patent: Nov. 3, 2020

(54) BATTERING RAM

(71) Applicant: David Krumrei, Maryville, TN (US)

(72) Inventor: David Krumrei, Maryville, TN (US)

( * ) Notice: Subject to any disclaimer, the term of this patent is extended or adjusted under 35 U.S.C. 154(b) by 544 days.

(21) Appl. No.: 15/270,788

(22) Filed: Sep. 20, 2016

Related U.S. Application Data

(60) Provisional application No. 62/221,460, filed on Sep. 21, 2015.

(51) Int. Cl.
*B25D 9/02* (2006.01)
*A62B 3/00* (2006.01)

(52) U.S. Cl.
CPC ..... *A62B 3/005* (2013.01); *B25D 9/02* (2013.01); *B25D 2250/221* (2013.01)

(58) Field of Classification Search
CPC .. A62B 3/005; A62B 3/00; B25D 9/02; B25D 2250/221; B25D 11/06; B25D 17/06; B25D 2217/0015; B25D 2222/72; B25B 21/02; B25B 21/026; B25B 23/1475; B25C 1/047; B25F 5/005
See application file for complete search history.

(56) References Cited

U.S. PATENT DOCUMENTS 3,071,994 A * 1/1963 Swenson ..... B25C 1/02 101/3.1
3,273,657 A * 9/1966 Willems et al. ..... A22B 3/02 173/121
3,803,983 A * 4/1974 Amtsberg ..... B25D 9/12 173/207
3,857,448 A * 12/1974 Lines ..... B25D 9/12 173/207
4,003,119 A 1/1977 Hugh
4,196,833 A * 4/1980 Haytayan ..... B25C 1/041 173/15
4,355,564 A * 10/1982 Gidlund ..... B25D 9/02 91/217
4,665,994 A 5/1987 Snider
4,681,171 A 7/1987 Kee
4,789,134 A 12/1988 Tenuto, Jr.
4,850,437 A * 7/1989 Sudnishnikov ..... B21J 15/18 173/13
5,044,033 A 9/1991 Fosberg
5,067,237 A 11/1991 Holder
5,088,174 A 2/1992 Hull
(Continued)

OTHER PUBLICATIONS

International Preliminary Report on Patentability or Application Serial No. PCT/US09/00776 dated Aug. 11, 2010.
(Continued)

*Primary Examiner* — Thanh K Truong
*Assistant Examiner* — David G Shutty
(74) *Attorney, Agent, or Firm* — Robinson IP Law, PLLC

(57) ABSTRACT

A breach apparatus is provided for breaching a closure or other obstacle. The breach apparatus includes a body forming a cavity, an end cap attached adjacent a first end of the body and a manifold attached adjacent a second end of the body and in fluid communication with the cavity, a ram assembly including a ram head attached to a first end of a battering shaft, a battering piston attached to a second end of the battering shaft within the cavity of the body, a mass piston movable within the cavity of the body between the manifold and the battering piston, a trigger mechanism in communication with the manifold, and a supply tank in fluid communication with the manifold.

10 Claims, 11 Drawing Sheets

(56) References Cited

U.S. PATENT DOCUMENTS 5,167,043 A 12/1992 Lopez
5,177,850 A 1/1993 Hull
5,243,761 A * 9/1993 Sullivan ..... A62B 3/005 173/169
5,329,685 A * 7/1994 Gillespie ..... A62B 3/005 173/90
5,398,773 A * 3/1995 Baker ..... A62B 3/005 173/202
5,408,795 A 4/1995 Eljadi et al.
5,415,241 A 5/1995 Ruffu et al.
5,533,579 A * 7/1996 Chu ..... B25D 9/08 173/13
5,540,136 A * 7/1996 Noord ..... F01L 21/04 417/398
5,987,723 A * 11/1999 McNally ..... A62B 3/005 173/141
6,035,946 A * 3/2000 Studley ..... A62B 3/005 173/128
6,318,228 B1 * 11/2001 Thompson ..... A62B 3/005 173/90
6,564,688 B2 * 5/2003 Sabates ..... A22B 3/02 173/212
6,913,088 B2 * 7/2005 Berger ..... B25D 11/005 173/201
7,814,822 B2 * 10/2010 Brennan ..... B25D 9/06 89/1.14
8,485,508 B1 * 7/2013 Newman ..... A62B 3/005 269/151
9,155,918 B2 10/2015 Krumrei
9,545,710 B2 * 1/2017 Boice ..... B25D 5/02
2002/0003045 A1 * 1/2002 Bongers-Ambrosius ..... B25D 16/00 173/201
2002/0112599 A1 * 8/2002 Sabates ..... A22B 3/02 89/1.14
2003/0056352 A1 * 3/2003 McLellan ..... B23P 19/025 29/252
2006/0192187 A1 * 8/2006 Jacquinot ..... A62B 3/005 254/93 R
2007/0182572 A1 * 8/2007 Rubin ..... G08B 7/06 340/574
2008/0217126 A1 * 9/2008 Bantle ..... E05F 5/08 188/297
2009/0199613 A1 * 8/2009 Krumrei ..... A62B 3/005 72/446
2011/0186321 A1 * 8/2011 Chambers ..... A62B 3/005 173/200
2013/0168117 A1 * 7/2013 Krumrei ..... A62B 3/005 173/1
2013/0306339 A1 * 11/2013 Boice ..... B25D 5/02 173/1
2014/0014384 A1 * 1/2014 Horie ..... B25F 5/02 173/217
2015/0367492 A1 * 12/2015 Lindell ..... B25D 17/24 173/211
2016/0221171 A1 8/2016 Neathery et al.
2016/0311104 A1 * 10/2016 Watanabe ..... B25D 17/06
2017/0129007 A1 * 5/2017 Lerda ..... B22D 29/005
2017/0361446 A1 * 12/2017 Hsieh ..... B25D 9/04
2018/0154505 A1 * 6/2018 Sato ..... B25C 1/008
2018/0169848 A1 * 6/2018 Phan ..... B25D 17/02

OTHER PUBLICATIONS

International Search Report and Written Opinion for Application Serial No. PCT/US2009/000776 dated May 26, 2009.

* cited by examiner

BATTERING RAM

CROSS-REFERENCE TO RELATED APPLICATION

This application claims priority to U.S. Provisional Patent Application Ser. No. 62/221,460 to David Krumrei for a "Battering Ram" filed on Sep. 21, 2015, the content of which is incorporated herein by reference in its entirety.

FIELD

This disclosure relates to the field of forced entry technology. More particularly, this disclosure relates to a battering ram for forced rapid entry through a locked, barred, or barricaded closure.

BACKGROUND

Battering ram devices are often used by law enforcement to forcibly enter barred, barricaded or locked closures or by firefighters and first responders who encounter locked or barred closures of dwellings or businesses during rescue situations. Many battering rams comprise a heavy ram device, which is swung toward a closure with intent to breach the closure. Many rams are heavy, difficult to use, cumbersome in tight quarters requiring sufficient room to operate the ram and often require two people to operate the ram efficiently.

In law enforcement, quick and efficient entry is essential for the safety of the law enforcement, the collection of evidence and to maintain the essential element of surprise to prevent the occupants from escape, destroying evidence or mounting violent resistance. Repeatedly battering a door while listening to "exigent noises" made by occupants now alerted to the situation is an extremely dangerous situation for law enforcement and may result in the escape of the occupants, destruction of evidence or injury or death of law enforcement personnel.

The physics for effectively breaching a door is explained well in U.S. Pat. No. 5,329,685 of Gillespie. As explained, there is no difference between the inert "dumb" rams of example in U.S. Pat. No. 4,681,171 of Kee et al., which in this case consists of a concrete-filled tube and the pneumatically powered battering ram in Gillespie. In both types of rams the speed and weight of the battering ram does indeed determine an initial total energy applied to the door. However, in both types of rams, the "dumb" ram and the pneumatically powered ram, the structural rigidity of the closure contributes greatly to the effectiveness of each type of ram.

As a "dumb" ram strikes a closure the kinetic energy generated by the velocity of the swing and the weight of the ram when transferred to the door is either sufficient to breach the structure or it is not. There is no high velocity mass involved. Multiple strikes with a "dumb" ram may be necessary which quickly result in fatigue for the operator and perhaps enhanced danger as well.

The pneumatically power assisted battering ram is far superior in breaching performance as it is designed to deliver a significantly higher striking velocity upon the closure by means of an internal battering bolt acting as a high speed mass which is propelled by a power source. However, if the structure to be breached "waffles" or contains "give or play" in its movement, the kinetic energy released upon impact by the "dumb" ram or the power assisted ram, even with its high velocity mass, will be either totally or partially absorbed in the flexion of the structure. Existing rams may struggle to reach a threshold force required to breach a closure as the structure to be breached simply "moves away" from the physical destruction threshold through flexion and structural lateral movement. Therefore, to be absolutely positive of delivering maximum kinetic energy from a battering ram the structure to be breached must first be put under maximum tension and that tension must be maintained throughout the battering bolt strike.

The present invention is designed to place the closure to be breached under tension during the initial strike by use of a spring within the battering apparatus. Further, this spring may be tuned to different compression tensions thereby accounting for the various types of closures encountered by placing greater or lesser resistance on the battering element that contacts the closure to be breached.

This design allows for a mechanically induced delay in the firing of the battering element while at the same time first placing the closure to be breached under tension by the battering element, thus assuring for maximum transfer of the kinetic energy from the battering ram.

SUMMARY

Embodiments of the present disclosure provide a battering ram for making forced entry through a locked, barricaded, or otherwise obstructed door or passage. In a first aspect, a breach apparatus is provided including: a body forming a cavity, the body including an end cap attached adjacent a first end of the body and a manifold attached adjacent a second end of the body, the manifold in fluid communication with the body; a ram assembly, the ram assembly including a ram head attached to a first end of a battering shaft, and a battering piston attached to a second end of the battering shaft, wherein the battering piston is positioned within the cavity of the body; a mass piston, the mass piston movable within the cavity of the body between the manifold and the battering piston; a trigger mechanism in communication with the manifold; and a supply tank in fluid communication with the manifold. When the trigger mechanism is activated, a compressed gas of the supply tank is introduced to the cavity of the body between the manifold of the body and the mass piston thereby forcing the mass piston into the battering piston to urge the ram assembly substantially outward away from the body.

In one embodiment, the ram assembly further includes a preload spring at least partially disposed within the battering shaft between the ram head and a preload nut. The ram head is movable between a first neutral position, a second compressed position when the preload spring is compressed, and a third extended position when the preload spring is in tension.

In another embodiment, the ram assembly further includes a trigger mechanism positioned between the ram head and the manifold. When the ram head of the ram assembly is in the compressed position the trigger mechanism releases a gas from the supply tank into the cavity between the mass piston and the manifold.

In yet another embodiment, the trigger mechanism includes a trigger bar attached to the ram assembly, the trigger bar extending through a center of the body and into the manifold.

In one embodiment, the trigger bar is threadably engaged with the preload nut such that a position of the preload nut may be adjusted by rotating the trigger bar.

In another embodiment, the trigger mechanism includes a sensor adjacent the ram head and one or more actuators adjacent the manifold. When the sensor detects a threshold force on the ram head the one or more actuators allow gas from the gas supply to be released into the cavity between the mass piston and manifold.

In yet another embodiment, the ram head is removably attached to the to the first end of the battering shaft.

In one embodiment, the ram assembly includes an absorber positioned within the housing adjacent the end cap of the body. The battering piston contacts the absorber after the mass piston contacts the battering piston.

In another embodiment, the mass piston is formed of a piston cylinder and an impulse shaper secured within the piston cylinder.

In yet another embodiment, the supply tank is a SKA-PAK® bottle.

In a second aspect, a breach apparatus is provided including: a body forming a cavity, the body including an end cap attached adjacent a first end of the body and a manifold attached adjacent a second end of the body, the manifold in fluid communication with the body; ram assembly, the ram assembly including: a ram head attached to a first end of a battering shaft, a battering piston attached to a second end of the battering shaft and positioned within the cavity of the body, and a preload spring at least partially disposed within the battering shaft between the ram head and a preload nut, a mass piston, the mass piston movable within the cavity of the body between the manifold and the battering piston; a trigger mechanism in communication with the manifold; and a supply tank in fluid communication with the manifold. The ram head is movable between a first neutral position, a second compressed position wherein the preload spring is substantially compressed, and a third extended position wherein the preload spring is substantially in tension. The trigger mechanism is activated when the ram head is in the second compressed position, and when the trigger mechanism is activated a compressed gas of the supply tank is introduced to the cavity of the body between the manifold of the body and the mass piston thereby forcing the mass piston into the battering piston to urge the ram assembly substantially outward away from the body.

In a third aspect, a method of breaching a closure is provided including the steps of: providing a breach apparatus, the breach apparatus including: a body forming a cavity, the body including an end cap attached adjacent a first end of the body and a manifold attached adjacent a second end of the body, the manifold in fluid communication with the body, a ram assembly including a ram head, wherein the ram head is movable between a first neutral position, a second compressed position wherein the preload spring is substantially compressed, and a third extended position wherein the preload spring is substantially in tension; contacting a closure with the breach apparatus such that the ram head is moved from the first neutral position to the second compressed position thereby placing the closure in tension; and extending the ram head from the second compressed position to the third extended position.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
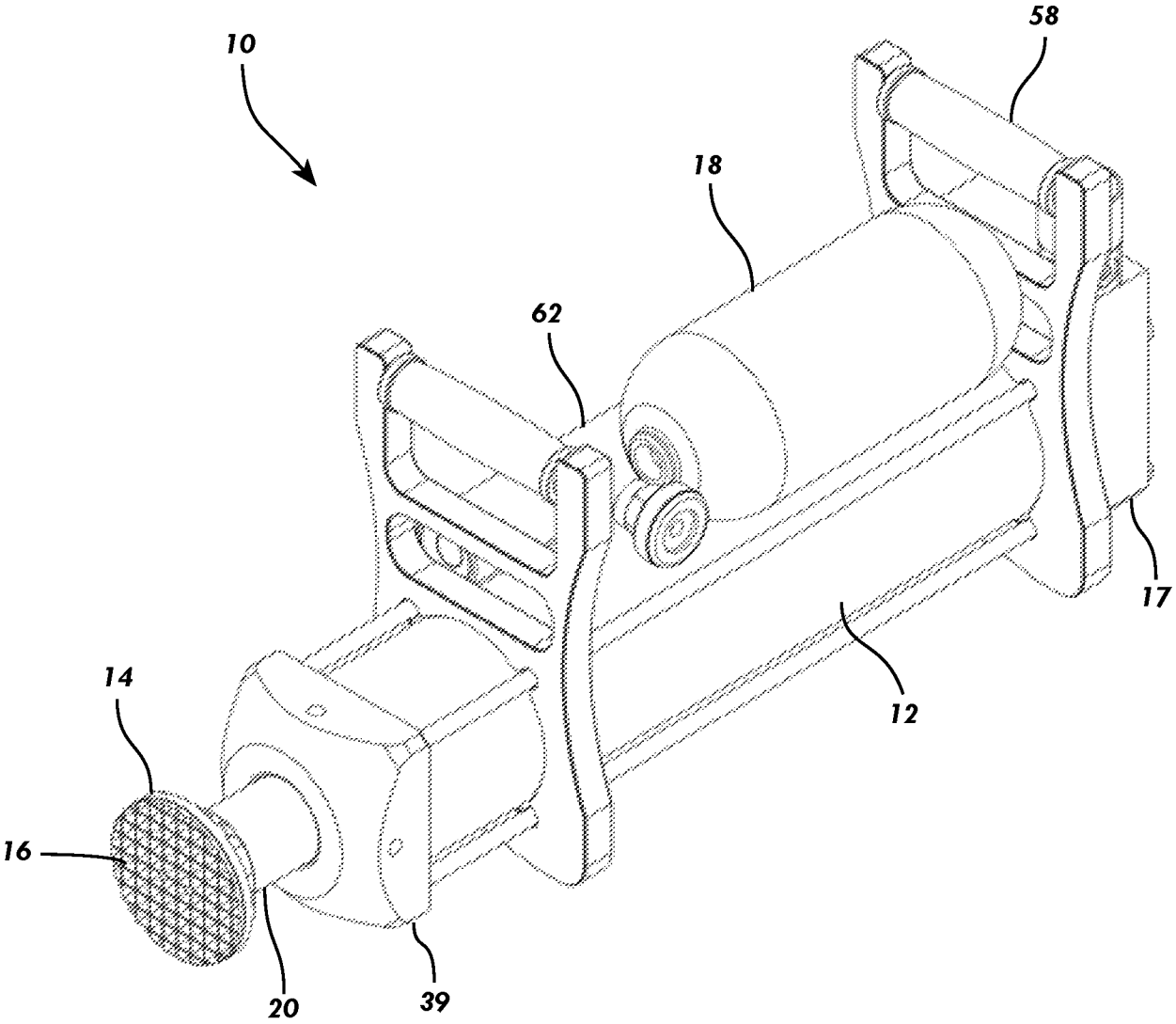
FIG. 1 shows a perspective view of a breach apparatus according to one embodiment of the disclosure.

FIG. 1 shows a basic embodiment of a handheld breaching apparatus 10 including a ram body 12 forming a cavity 13, a ram head 14 having a battering contact surface 16, and a manifold 17 in fluid communication with the cavity of the ram body 16. A removable supply tank 18 is attached to the body 12 of the breaching apparatus 10. The handheld breaching apparatus 10 is configured to place the ram head 14 in contact with a closure or other surface, such as a locked door, and a gas from the supply tank 18 propels the ram head 14 against the closure thereby forcibly opening the closure.

Figure 2:
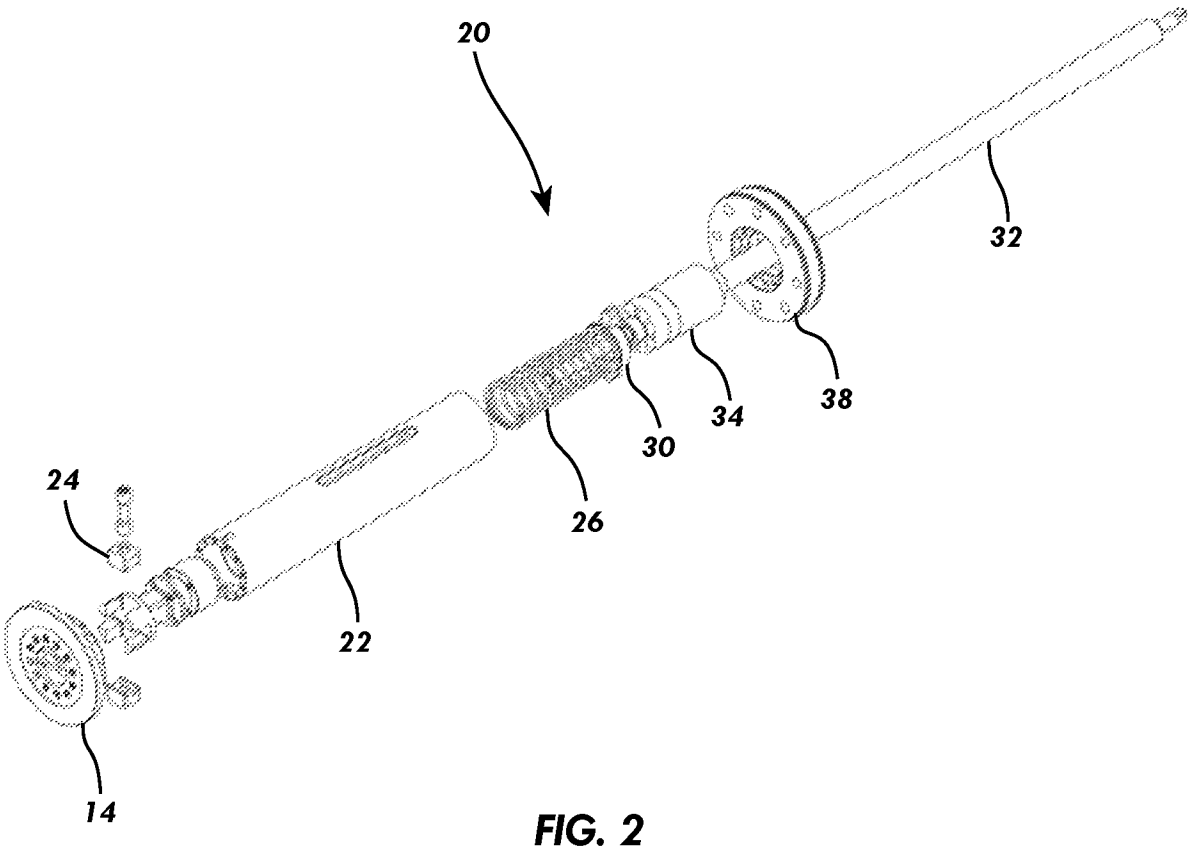
FIG. 2 shows an exploded view of a ram assembly according to one embodiment of the disclosure.

Referring now to FIG. 2, the breaching apparatus 10 includes a ram assembly 20 that includes the ram head 14. The ram assembly 20 is at least partially disposed within the body 12 and is configured to move from a first rest position to a second compressed position, and then to a third extended position before returning to the first rest position as discussed in greater detail below. The ram head 14 is attached to a battering shaft 22 with a battering face clamp 24. The battering face clamp 24 enables removal of the ram head 14 from the battering shaft 22 such that the ram head 14 may be readily replaced.

A preload spring 26 is secured within the battering shaft 22 between a preload nut 28 and a retainer cup 30. A trigger rod 32 is partially disposed within the battering shaft 22 and is attached to the ram assembly 20 with a hub 34 engaged with a collar 36 (FIG. 6) of the trigger rod 32. A cylindrical battering piston 38 is attached to the ram assembly 20 adjacent the retainer cup 30 and hub 34.

Figure 3:
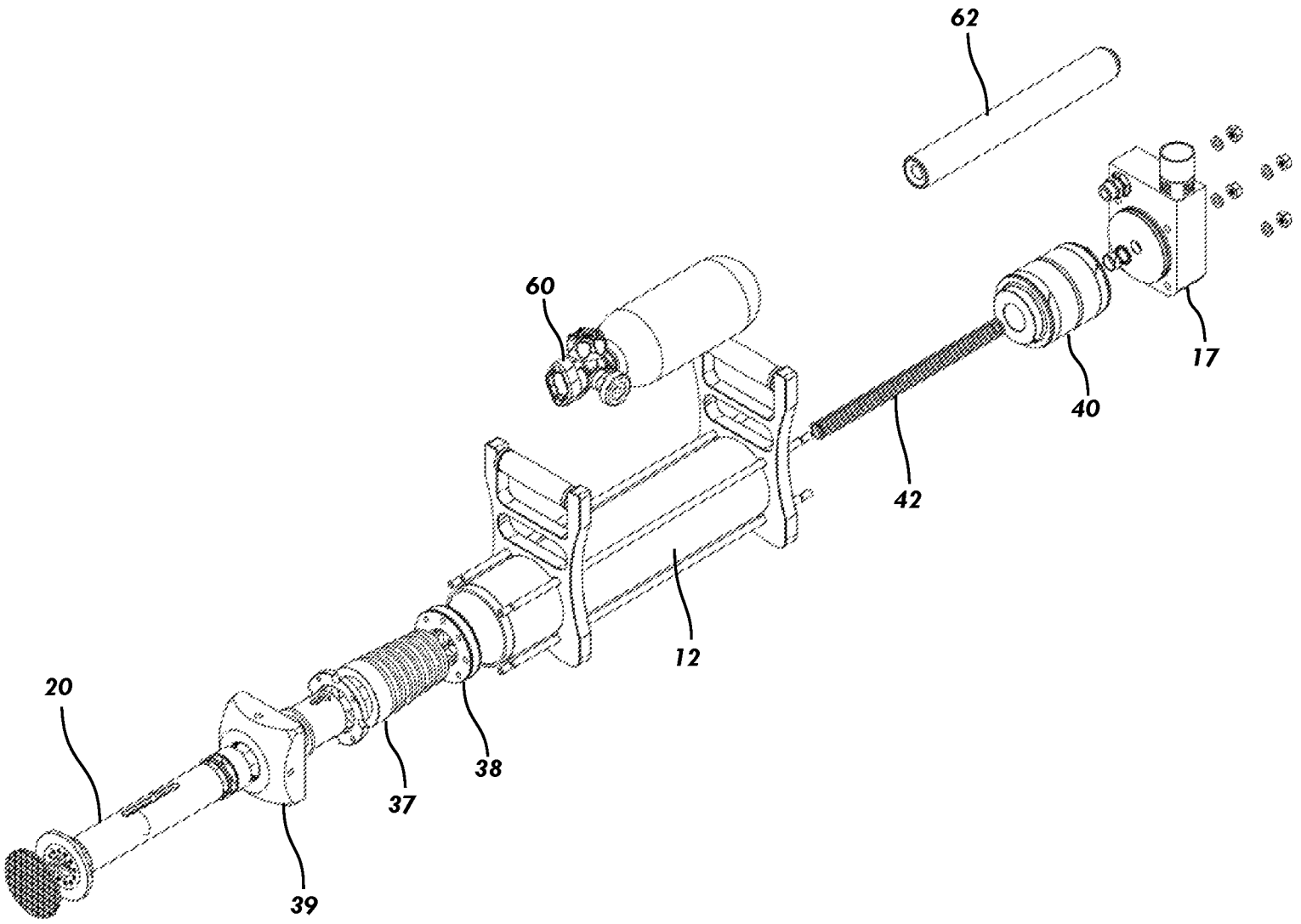
FIG. 3 shows an exploded view of a breach apparatus according to one embodiment of the disclosure.

The ram assembly 20 extends through an absorber 37 (FIG. 3) is positioned within the housing 12 around the ram assembly 20 and is attached adjacent the end cap 39 at an end of the body 12. The absorber 37 is preferably formed of a flexible resilient material capable of absorbing a mechanical impact.

The ram assembly 20 is at least partially disposed within the body 12 of the breaching apparatus 10 and extends through the end cap 39 attached to an end of the body 12. The trigger rod 32 extends along a lateral midline of the body 12, through a mass piston 40 and a mass piston return spring 42, and through the manifold 17 attached adjacent a rear of the body 12.

Figure 5:
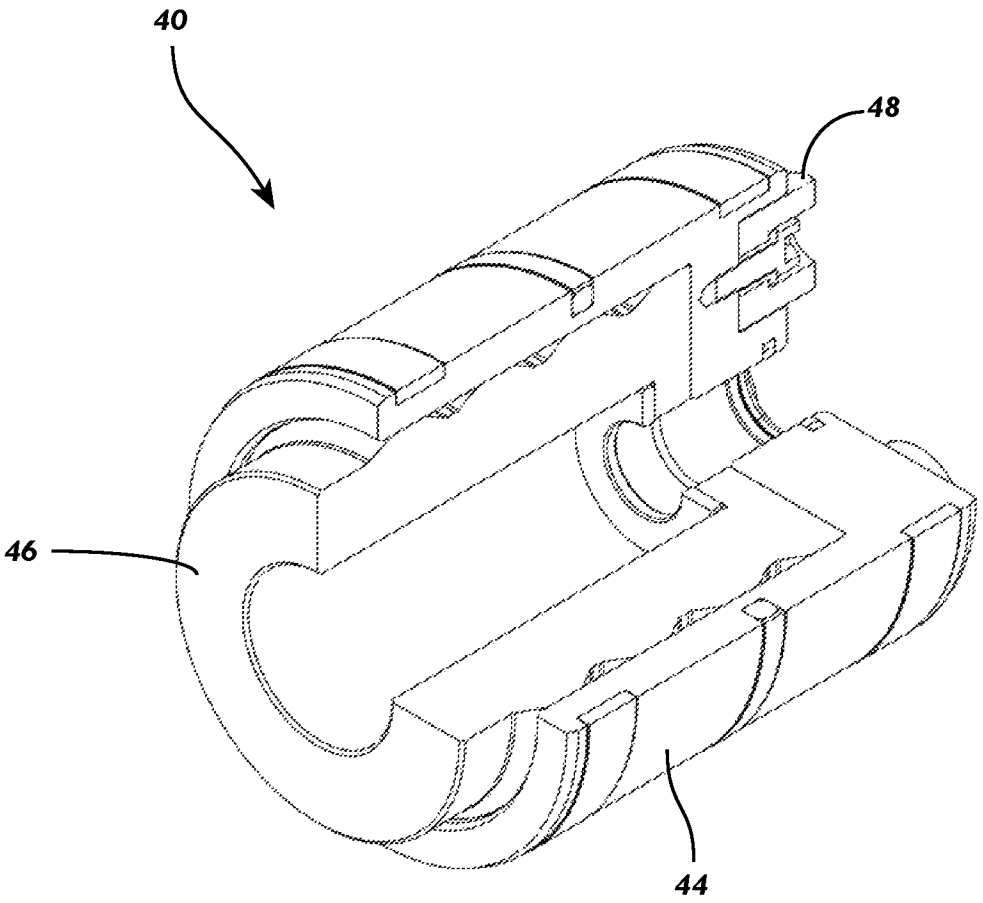
FIG. 5 shows mass piston according to one embodiment of the disclosure.
Figure 6:
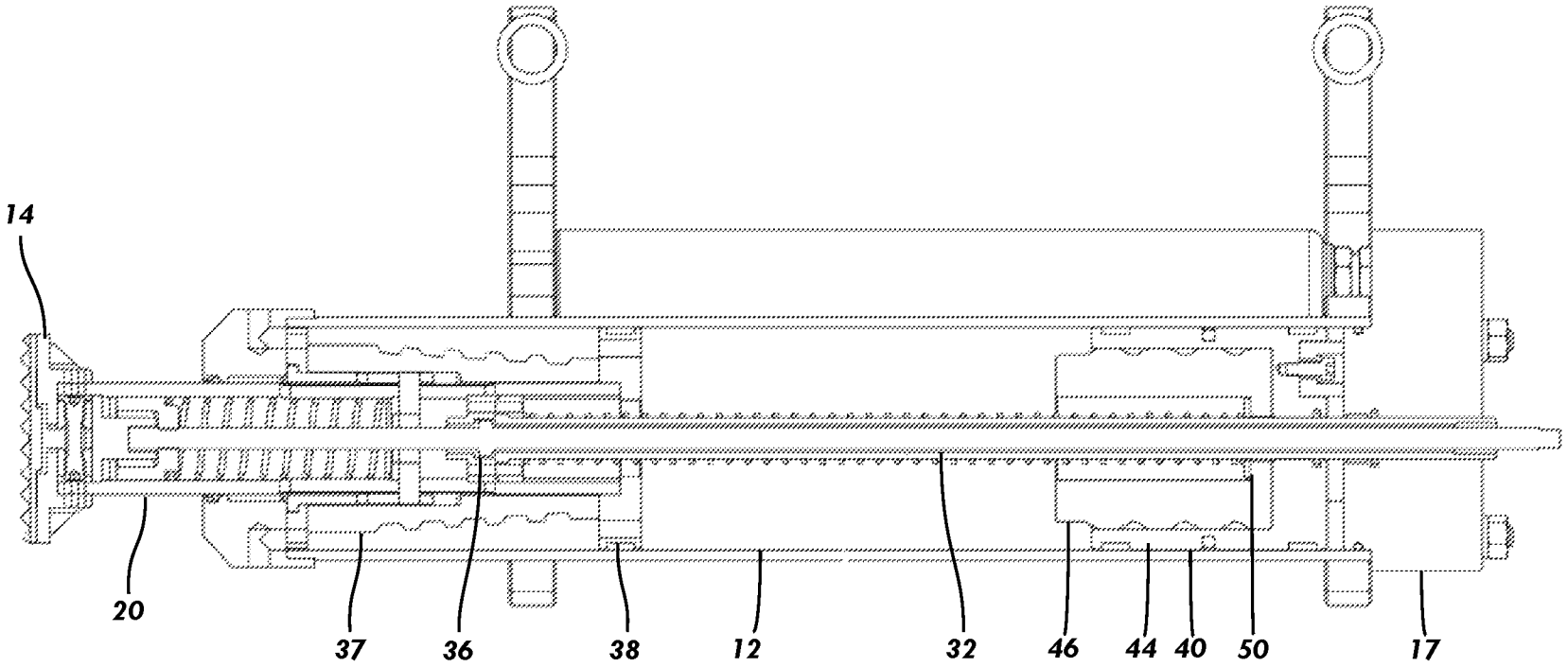
FIG. 6 shows a cross-sectional side-view of a breach apparatus according to one embodiment of the disclosure.
Figure 7:
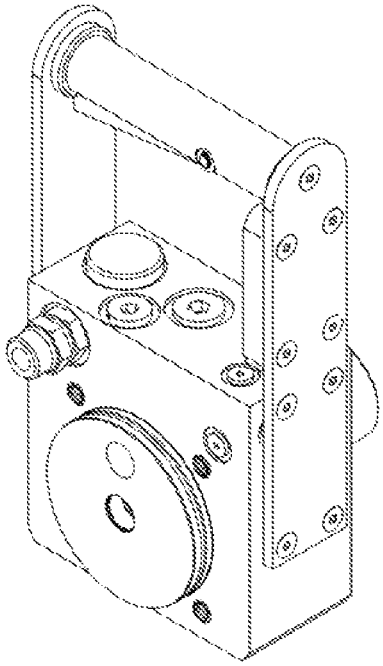
FIGS. 7-13 show a manifold of a breach apparatus according to one embodiment of the disclosure.
Figure 8:
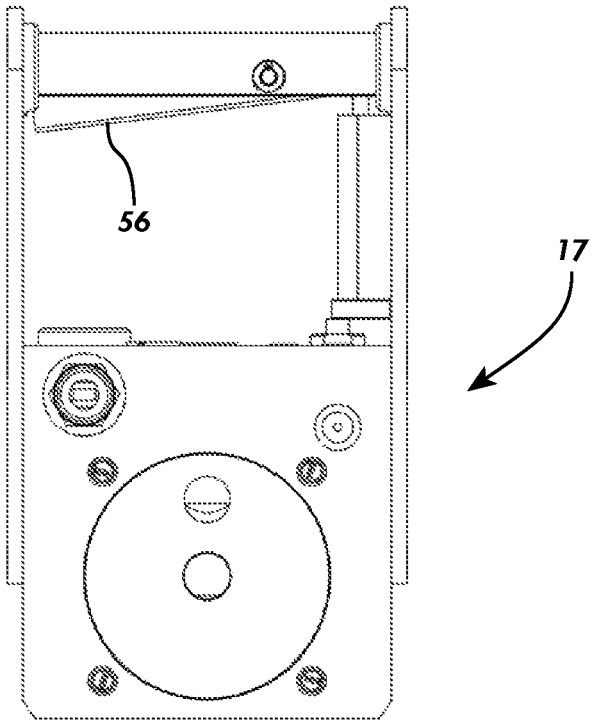
Figure 9:
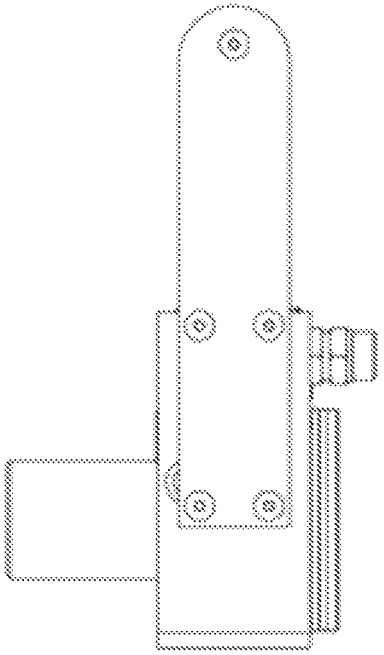
Figure 10:
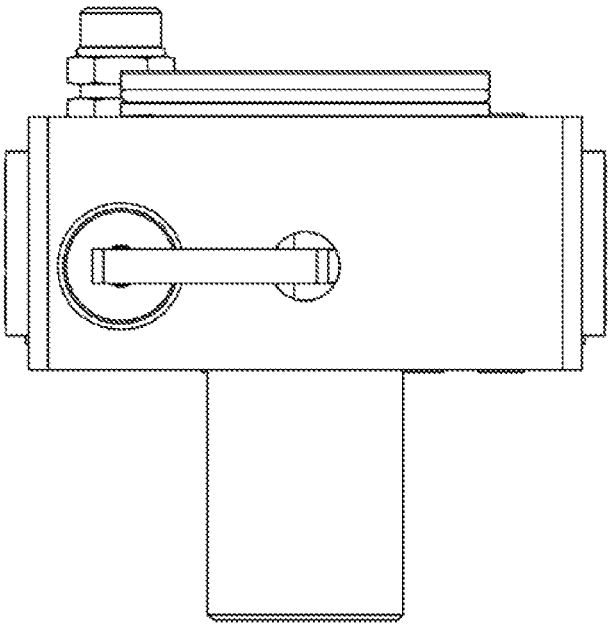

Referring now to FIGS. 5 and 6, the mass piston 40 includes a piston cylinder 44 and an impulse shaper 46 secured within the piston cylinder 44. The mass piston 40 also includes one or more bumpers 48 formed of an elastic material such as polyurethane for absorbing excess recoil generated during operation of the breaching apparatus 10. The mass piston 40 is positioned within the body 12 and slidably moves along a length of the trigger rod 32.

The mass piston return spring 42 is secured at a first end adjacent the hub 34 of the ram assembly 20 and at a second end adjacent a spring collar 50 of the mass piston 40. The mass return spring 42 extends along a length of the trigger rod 32 and urges the mass piston 40 against the manifold 17.

The manifold 17, an embodiment of which is illustrated in FIGS. 7-13, is secured to an end of the body 12 of the breach apparatus 10 and is in fluid communication with the supply tank 18. The manifold 17 may include one or more valves for providing a gas from the supply tank 18 to an interior of the body adjacent the mass piston 40, wherein the gas is introduced between the manifold 17 and the adjacent mass piston 40 to propel the mass piston 40 away from the manifold 17 and towards the ram assembly 20.

Figure 11:
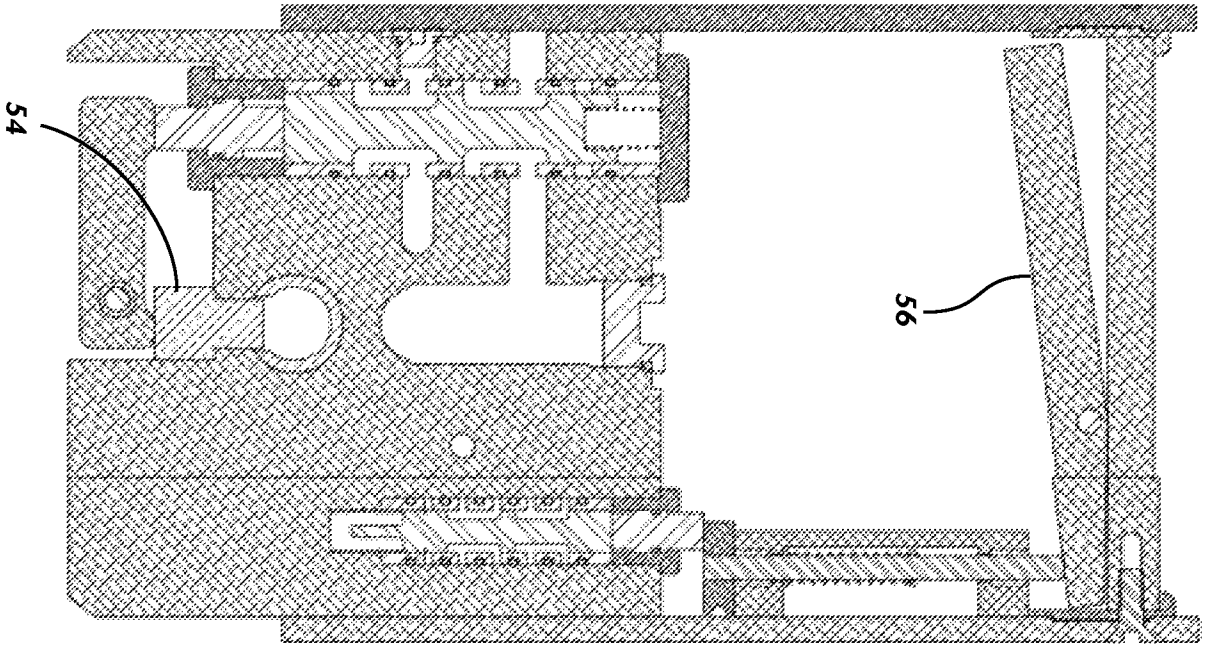
Figure 12:
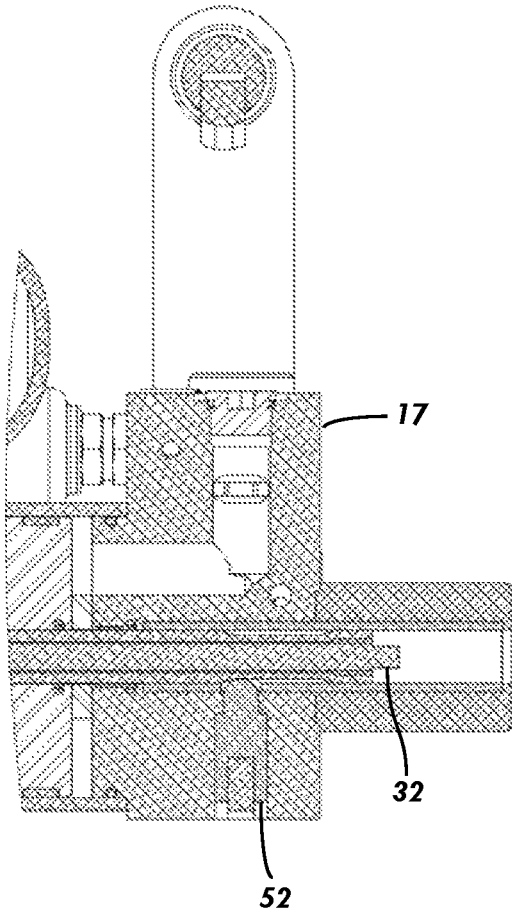
Figure 13:
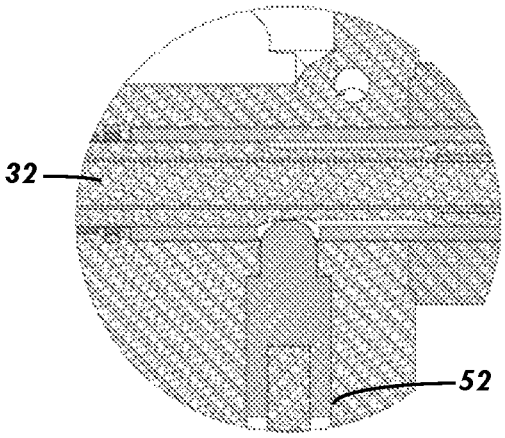

The manifold 17 receives the trigger rod 32 through a bore 52. Referring now to FIGS. 12 and 13, the trigger rod 32 may contact a trigger contact 54. The trigger rod 32 may include a shaped surface such that as the trigger rod 32 moves with respect to the manifold 17 and trigger contact 52, the trigger contact is urged downward. The trigger contact 52 may be in communication with one or more valves, an example of which is illustrated in FIG. 11, such that when the trigger rod 32 moves the trigger contact 52, the one or more valves are opened thereby releasing gas from the supply tank 18 and into the housing 12 to propel the mass piston 40 towards the ram assembly 20.

The manifold 17 may also include a movable user switch 56 attached adjacent a handle 58 on the manifold 17. The user switch 56 may be connected to one or more valves between the supply tank 18 and the housing 12 such that a user is required to hold the user switch 56 in an open position to allow gas to flow into the manifold 17. Further, the user switch 56 may be in communication with one or more relief valves within the manifold 17, such that if a user releases the user switch 56 after moving the switch to the open position, any gas within the manifold or supply lines is released such that the breach apparatus 10 is rendered substantially inert.

While the above description contemplates a trigger rod extending along a length of the breach apparatus 10 to the manifold for activating a flow of gas from the supply tank 18 to the housing, it is also understood that other like mechanisms may be used to activate the flow of gas. For example, one or more additional mechanical, electrical, or pneumatic linkages may be placed between the ram assembly 20 or body 12 and the manifold 17 such that movement of the ram assembly 20 or body 12 induces a flow of gas from the supply tank 18 to the body 12. Similarly, various electrical or electromechanical systems may be used to activate a flow of gas to the body 12 to propel the mass piston 40 towards the ram assembly 20.

Referring again to FIG. 1, the removable supply tank 18 is supported adjacent the body 12 of the breach apparatus 10. A valve 60 (FIG. 3) is attached to the supply tank 18 and includes one or more knobs for allowing a flow of gas out of the supply tank 18 and valve 60. A reservoir tank 62 is attached to the breach apparatus 10 adjacent the supply tank 18 and is in fluid communication with the valve 60 and the manifold 17. While the reservoir tank 62 is illustrated as a cylindrical tank attached to the body 12 of the breach apparatus 10, it is also understood that embodiments of the reservoir tank 62 may be positioned adjacent other parts of the breach apparatus 10, such as adjacent the manifold 17. Alternatively, the reservoir tank 62 may be formed as part of the breach apparatus 10, such as by forming the body out of a dual wall cylinder and using a space between the walls as the reservoir tank 62.

In one embodiment, the supply tank 18 is formed of a SKA-PAK® tank configured to be used with a breathing apparatus or supplied air respirator, such as a self-contained breathing apparatus (S.C.B.A.) bottle made by various companies. Further, the valve 60 may be formed of a high pressure quick disconnect type valve configured to readily accept the SCBA's RIT LINE connected to a SCBA bottle, such as an EATON® FD17 series high pressure coupling. The purpose of which is to allow the transfer of "lifesaving" air from the supply tank 18 through a high pressure quick disconnect coupling, such as the Eaton FD-17, to the firefighter's SCBA bottle. The above exemplary supply tank 18 and valve 60 are not intended to be limiting, and it is understood that the breach apparatus may be configured to accept various other types of air supply tanks adaptable to other types of available valves.

One or more of the quick connect couplings may be positioned adjacent the supply tank 18 or the manifold 17. The quick connect coupling allows a gas to be exchanged between the supply tank 18 and an external tank such as an SCBA bottle, as discussed in further detail below.

Figure 4:
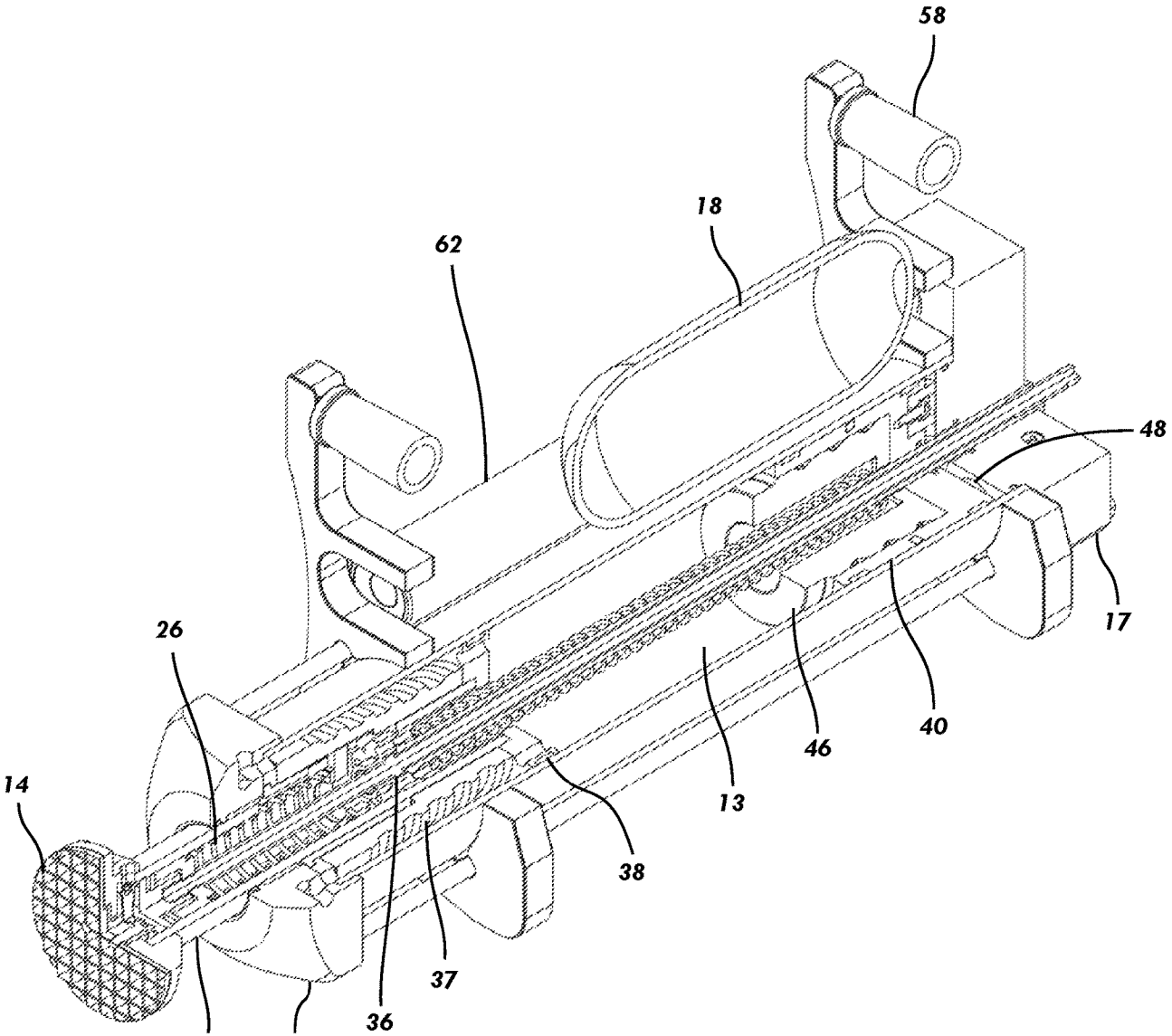
FIG. 4 shows cut-away perspective view of a breach apparatus according to one embodiment of the disclosure.

In operation, pressurized gas from the supply tank 18 pressurizes the reservoir tank 62 and further flows into the manifold 17 where it is prevented from entering the body 12 by one or more valves in the manifold 17 (FIG. 4). When a triggering event occurs, such as when the trigger rod 32 contacting the trigger contact 52, valves of the manifold 17 open thereby allowing the pressurized gas to expand within the body 12 between the manifold 17 and the mass piston 40.

As the pressurized gas expands, the mass piston 40 is propelled along a length of the body 12 towards the ram assembly 20 until the impulse shaper 46 of the mass piston 40 contacts the cylindrical battering piston 38. When the mass piston 40 contacts the cylindrical battering piston 38, the battering piston 38 and attached ram head 14 are urged linearly away from the body 12 until the ram head 14 contacts a closure such as a locked door or other object. In the event that the breach apparatus 10 is "dry fired", namely when the breach apparatus 10 is activated and the ram head 14 does not contact a closure or other obstacle, the ram assembly 20 is stopped when the cylindrical battering piston 38 contacts the absorber 37 within the body 12, thereby dissipating energy of the ram assembly 20 and reducing a shock on the breach apparatus 10.

After the ram head 14 contacts a closure or the cylindrical batter piston 38 contacts the absorber 37, the mass piston 40 is urged to its initial position adjacent the manifold 17 by the mass piston return spring 42. The ram assembly 20 is urged to its initial position by the preload spring 26.

Figure 14:
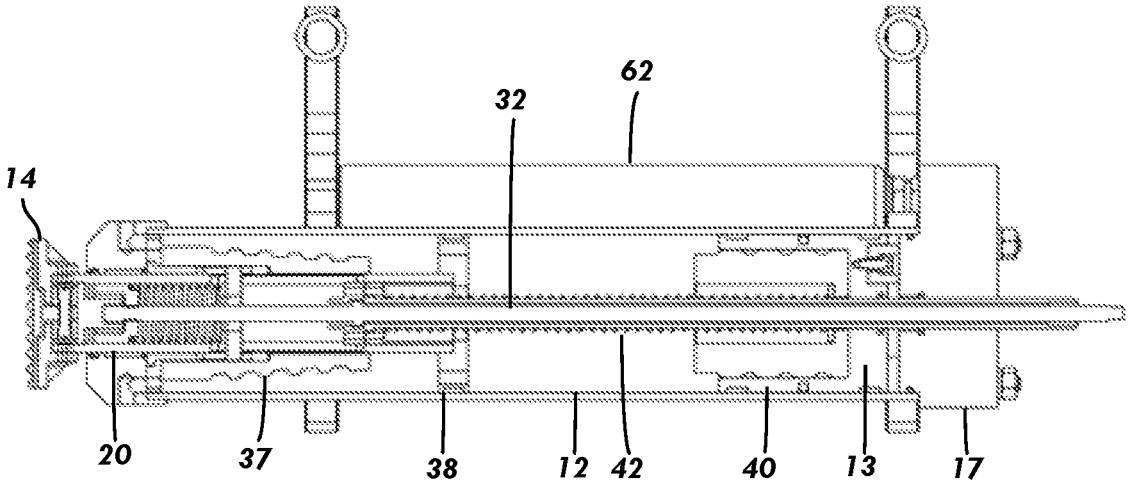
FIG. 14 shows a cross-sectional side view of a breach apparatus with the ram head in a first neutral position according to one embodiment of the disclosure.
Figure 15:
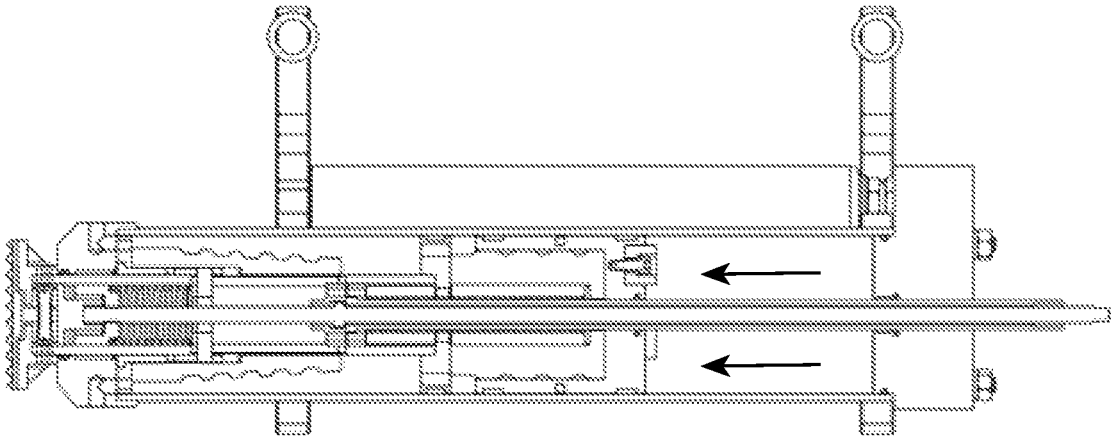
FIG. 15 shows a cross-sectional side view of a breach apparatus with the ram head in a second compressed position according to one embodiment of the disclosure.
Figure 16:
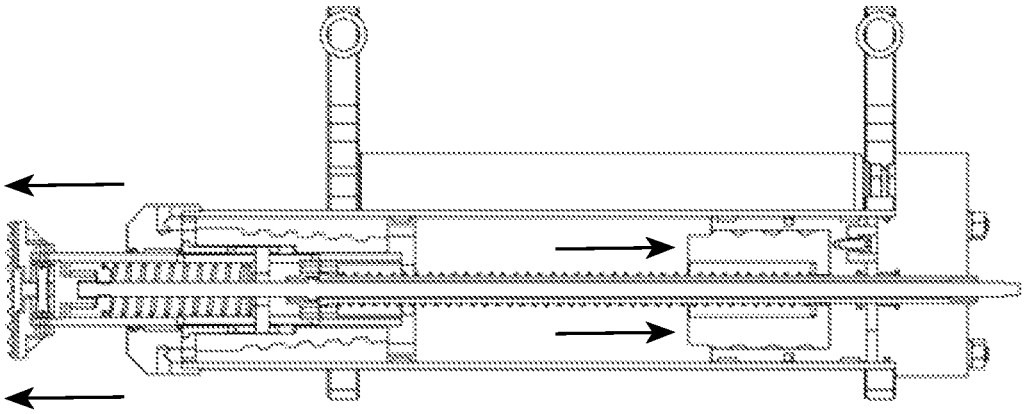
FIG. 16 shows a cross-sectional side view of a breach apparatus with the ram head in a third extended position according to one embodiment of the disclosure.

Referring now to FIGS. 14-16, the ram head 14 moves between a first position wherein the ram assembly 20 is in a neutral rest position (FIG. 14), a second position wherein the ram assembly 20 is in a compressed position (FIG. 15), and a third position wherein the ram assembly 20 is in an extended position (FIG. 16).

In the first rest position, illustrated in FIG. 14, the mass piston 40 is maintained adjacent the manifold 17 by the mass piston return spring 42, and the ram head 14 is partially extended from the body 12 of the breach apparatus 10. Before activating the breach apparatus 10, the supply tank 18 is attached to the breach apparatus 10 and gas from the supply tank 18 is prevented from entering the body 12 by the manifold 17.

In the second compressed position illustrated in FIG. 15, the ram head 14 is compressed towards the end cap 39, such as when a user urges the ram head 14 against a closure. When the ram head 14 is compressed, the trigger rod 32 moves the trigger contact 54 such that one or more valves of the manifold open and release the compressed gas from the supply tank 18 into the body 12 between the manifold and the mass piston 40. Rapid expansion of the compressed gas forces the mass piston 40 away from the manifold 17 until the impulse shaper 46 of the mass piston impacts the battering piston 38 attached to the ram assembly 20.

Impact of the impulse shaper 46 of the mass piston 40 with the battering piston 38 forces the ram assembly 20 into the third extended position illustrated in FIG. 16. The ram assembly 20 extends until the ram head 14 contacts a closure and/or the battering piston 38 of the ram assembly 20 contacts the absorber 37, wherein the absorber 37 absorbs excess energy of the impacted battering piston 38.

After contacting the battering piston 38, the mass piston 40 is urged to its original position adjacent the manifold 17 by the mass piston return spring 42. The bumpers 48 of the mass piston 40 absorb energy of the mass piston 40 as it contacts the manifold. The ram assembly 20 is urged to the first rest position by the preload spring 26.

The three-position operation of the breach apparatus 10 provides a delay in activation of the breach apparatus 10 during breach of a closure. Specifically, the preload spring and delayed trigger maintain the ram head 14 against the closure surface and place a pressure on the closure thereby reducing or totally eliminating "give or play" in the closure by placing the closure under tension prior to activating the breach apparatus 10. This delay prevents the breach apparatus 10 from rebounding from a surface of the closure prior to activation of the breach apparatus 10 and thereby ensures that maximum energy is imparted upon the closure structure during operation of the breach apparatus 10.

Additionally, the use of a removable supply tank 18 such as a SKA-PAK® tank allows readily available sources of gas to be used. For example, an emergency responder may utilize SKA-PAK® tanks already on hand to propel the ram assembly 20 of the breach apparatus 10. In an emergency situation, such as a total depletion of breathable air in the firefighter's SCBA tank, the firefighter may remove the SKA-PAK® tank from the breach apparatus 10 and use that tank as an additional source of life saving breathable air. Alternatively, if a responder needs to continue working or make an emergency exit and has depleted the air supply of the SKA-PAK bottle of the breach apparatus 10, the firefighter may attach his SCBA tank to the breach apparatus 10, thereby providing an additional compressed gas source for operating the breach apparatus 10.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The breach apparatus is further described below:

1. A breach apparatus comprising:

a body forming a cavity, the body including an end cap attached adjacent a first end of the body and a manifold attached adjacent a second end of the body, the manifold in fluid communication with the body;

a ram assembly, the ram assembly including:

a ram head having a battering contact surface for a surface of a door, the ram head attached to a first end of a battering shaft, a battering piston attached to a second end of the battering shaft, wherein the battering piston is slidably positioned within the cavity of the body, and a trigger rod extending from the ram assembly through the manifold adjacent the second end of the body and including a retainer cup adjustably mounted thereon, wherein a position of the retainer cup on the trigger rod is adjustable from outside of the body;

a mass piston, the mass piston movable within the cavity of the body between the manifold and the battering piston;

a trigger mechanism in communication with the manifold;

a trigger contact adjacent to at least a portion of the trigger rod;

a supply tank in fluid communication with the manifold;

a preload spring at least partially disposed within the battering shaft between the ram head and the retainer cup mounted on the trigger rod, wherein the ram head is movable between a first neutral position, a second compressed position wherein the preload spring is substantially compressed, and a third extended position wherein the preload spring is substantially in tension;

wherein the trigger rod is adjustably coupled with the preload spring such that a preload of the ram head is adjustable with the trigger rod;

wherein in a preloaded configuration, the ram head is moved to the second compressed position and the trigger rod into contact with the trigger contact;

wherein when the trigger mechanism is activated and the breach apparatus is in the preloaded configuration, a compressed gas of the supply tank is introduced to the cavity of the body between the manifold of the body and the mass piston thereby forcing the mass piston into the battering piston to urge the ram assembly substantially outward away from the body.

2. The breach apparatus of claim 1, the trigger mechanism positioned between the ram head and the manifold, wherein when the ram head of the ram assembly is in the second compressed position the trigger mechanism releases the compressed gas from the supply tank into the cavity between the mass piston and the manifold.

3. The breach apparatus of claim 1, wherein the trigger rod extends substantially through a center of the body and the manifold.

4. The breach apparatus of claim 3, wherein the trigger rod is threadably adjustable relative to the preload spring such that the preload of the ram head is adjustable by rotating the trigger rod.

5. The breach apparatus of claim 2, wherein the trigger mechanism comprises a sensor adjacent the ram head and one or more actuators adjacent the manifold, wherein when the sensor detects a threshold force on the ram head the one or more actuators allow the compressed gas from the supply tank to be released into the cavity between the mass piston and the manifold.

6. The breach apparatus of claim 1, wherein the ram head is removably attached to the first end of the battering shaft.

7. The breach apparatus of claim 1, further comprising an absorber positioned within the body adjacent the end cap of the body, wherein the battering piston contacts the absorber after the mass piston contacts the battering piston.

8. The breach apparatus of claim 1, wherein the mass piston is comprised of a piston cylinder and an impulse shaper secured within the piston cylinder.

9. The breach apparatus of claim 1, wherein the supply tank is a bottle adapted for use with a self-contained breathing apparatus.

10. A breach apparatus comprising:

a body forming a cavity, the body including an end cap attached adjacent a first end of the body and a manifold attached adjacent a second end of the body, the manifold in fluid communication with the body;

a ram assembly, the ram assembly including:

a ram head attached to a first end of a battering shaft, a battering piston attached to a second end of the battering shaft and positioned within the cavity of the body, a trigger rod extending from the ram assembly through the manifold adjacent the second end of the body and including a retainer cup adjustably mounted thereon, wherein a position of the retainer cup on the trigger rod is adjustable from outside of the body, and a preload spring at least partially disposed within the battering shaft between the ram head and a cup of the trigger rod, a mass piston, the mass piston movable within the cavity of the body between the manifold and the battering piston;

a trigger mechanism in communication with the manifold; and a trigger contact adjacent to at least a portion of the trigger rod;

a supply tank in fluid communication with the manifold;

wherein the ram head is movable between a first neutral position, a second compressed position wherein the preload spring is substantially compressed, and a third extended position wherein the preload spring is substantially in tension;

wherein the trigger rod is adjustably coupled with the preload spring such that a preload of the ram head is adjustable with the trigger bar;

wherein in a preloaded configuration, the ram head is moved to the second compressed position and the trigger rod into contact with the trigger contact;

wherein when the trigger mechanism is activated and the breach apparatus is in the preloaded configuration, a compressed gas of the supply tank is introduced to the cavity of the body between the manifold of the body and the mass piston thereby forcing the mass piston into the battering piston to urge the ram assembly substantially outward away from the body.

* * * * *